United States Patent [19]

Karp

[11] Patent Number: 4,745,960

[45] **Date of Patent: * May 24, 1988**

[54] COLLAPSIBLE PARTITION ASSEMBLY

[76] Inventor: S. J. Karp, 1828 Boulevard, West Hartford, Conn. 06107

[ * ] Notice: The portion of the term of this patent subsequent to Feb. 10, 2004 has been disclaimed.

[21] Appl. No.: 516

[22] Filed: Jan. 5, 1987

Related U.S. Application Data

[63] Continuation-in-part of Ser. No. 835,176, Mar. 3, 1986, Pat. No. 4,642,605.

[51] Int. Cl.[4] ..... E06B 3/94

[52] U.S. Cl. ..... 160/84.1; 40/607; 40/610

[58] Field of Search ..... 160/84 R, 134; 40/606, 40/607, 610, 584; D3/2

[56] References Cited

U.S. PATENT DOCUMENTS 823,096 6/1906 Armstrong ..... 160/134 X
4,642,605 2/1987 Karp ..... 40/610 X

FOREIGN PATENT DOCUMENTS 815405 6/1959 United Kingdom ..... 160/134

*Primary Examiner*—Ramon S. Britts
*Assistant Examiner*—Blair M. Johnson
*Attorney, Agent, or Firm*—Chilton, Alix & Van Kirk

[57] ABSTRACT

A collapsible partition assembly comprises an elongated arm which is pivoted to an elongated frame. The arm is pivotal between a storage position wherein the frame and the arm form an enclosure and a second position wherein the arm projects away from the frame to open the enclosure. A foldable partition is connected in fixed relationship with the arm and the frame so that the partition is substantially entirely enclosed in the enclosure when the arm is in a storage position. The partition expands to form a substantially rectangularly shaped panel. The partition is comprised of a plurality of flexibly connected elongated panel strips which cooperate to define a corrugated structure which is expandable and contractable relative to two generally orthogonal axes.

10 Claims, 3 Drawing Sheets

COLLAPSIBLE PARTITION ASSEMBLY

CROSS-REFERENCE TO RELATED APPLICATION

This application is a continuation-in-part of U.S. application Ser. No. 835,176 filed on Mar. 3, 1986, now U.S. Pat. No. 4,642,605.

BACKGROUND OF THE INVENTION

This invention relates generally to removable or portable panels or partitions. More particularly, the present invention relates generally to partitions which may be easily transformed from a collapsed storage mode to an expanded mode for use as a room divider or other useful function.

SUMMARY OF THE INVENTION

Briefly stated, the invention in a preferred form is a collapsible partition assembly which comprises an elongated support member which is adapted to be mounted for disposition in a generally upright orientation. An elongated expander arm is pivotally mounted at one end of the support member. The arm is pivotal between a first generally upright position wherein the support member and the arm are generally parallely oriented and cooperate to form an enclosure and a second expanded position wherein the arm projects away from the support member to open the enclosure. A foldable partition has first and second edge portions wherein the first edge portion is connected in fixed relationship to the support member and the second edge portion is connected in fixed relationship to the expander arm. The partition is foldable so as to be substantially entirely enclosed in the enclosure when the expander arm is in the first position and the partition is expandable to form a substantially rectangularly shaped panel when the arm is in the second expanded position. A latch holds the arm in the first position and is releasable to release the arm for pivotal movement to the second position. The latch may be in the form of a sliding frictional engagement between portions of the support member and the expander arm.

The foldable partition or panel member comprises a plurality of flexibly connected elongated strips which cooperate to define a corrugated structure which is expandable and contractable relative to two generally orthongally disposed axes. The corrugated structure includes a pair of generally triangularly shaped sections. The orientation of strips within one of the two sections is generally transverse to the orientation of the strips of the other section. A stop is provided to limit the pivotal movement of the arm to the expanded second position. The arm includes a pivot end and a latch end. The arm has side panels which are tapered from the pivot end to the latch end. A reel is employed for pivotally drawing the arm from the second expanded position to the first upright position. A cord connects the elongated strips with the support member and the arm to yieldably resist movement of the arm from the first position to the second position.

An object of the invention is to provide a new and improved collapsible partition assembly of efficient construction which may be easily converted to and from a collapsed storage mode and an expanded mode for use.

Another object of the invention is to provide a new and improved collapsible partition assembly having a pleasing appearance and being adaptable for use as a removable thermal barrier, sound barrier or visual barrier.

A further object of the invention is to provide a new and improved collapsible partition assembly of compact modular form which may be employed for mounting temporary traffic signs, warning signs, advertisements and other printed media.

A further object of the invention is to provide a new and improved collapsible partition assembly adaptable for use in existing buildings and structures presenting severe dimensional constraints. Wherein the assemblies may be expanded from a compact configuration to form a partition of substantial size.

Other objects and advantages of the invention will become apparent from the specification and the drawing.

DETAILED DESCRIPTION OF THE INVENTION

Figure 1:
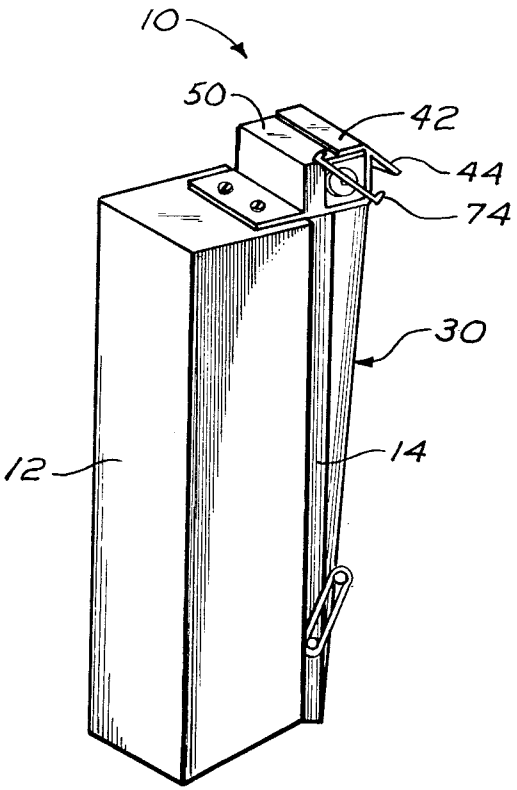
FIG. 1 is a perspective view of a collapsible partition assembly in accordance with the present invention, said assembly being illustrated in a storage mode and mounted to a support post.
Figure 3:
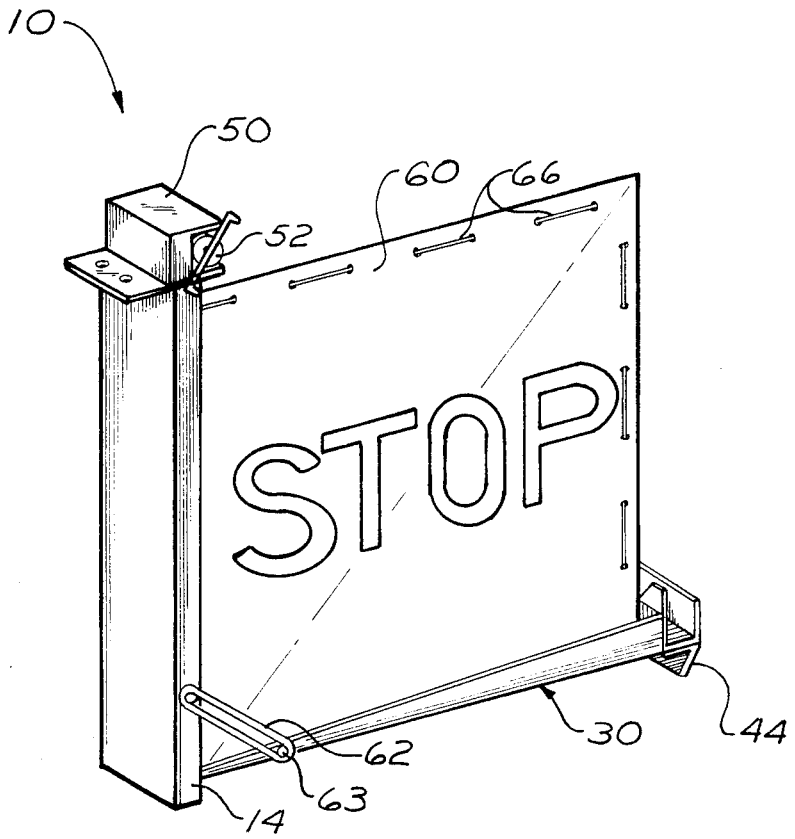
FIG. 3 is a perspective view of the collapsible partition assembly of FIG. 1, said assembly being illustrated in the expanded mode.

With reference to the drawing wherein like numerals represent like parts throughout the figures, a collapsible partition assembly in accordance with the present invention is generally designated by the numeral 10. Partition assembly 10 has an efficient modular form and in its numerous applications may be employed to provide a collapsible room partition, a removeable thermal barrier, a removeable sound barrier or a temporary sign. The partition assembly is expandable from a collapsed storage mode as illustrated in FIG. 1 to an expanded mode forming a partition as illustrated in FIG. 3. The partition assembly is readily collapsible back to the storage mode.

Figure 4:
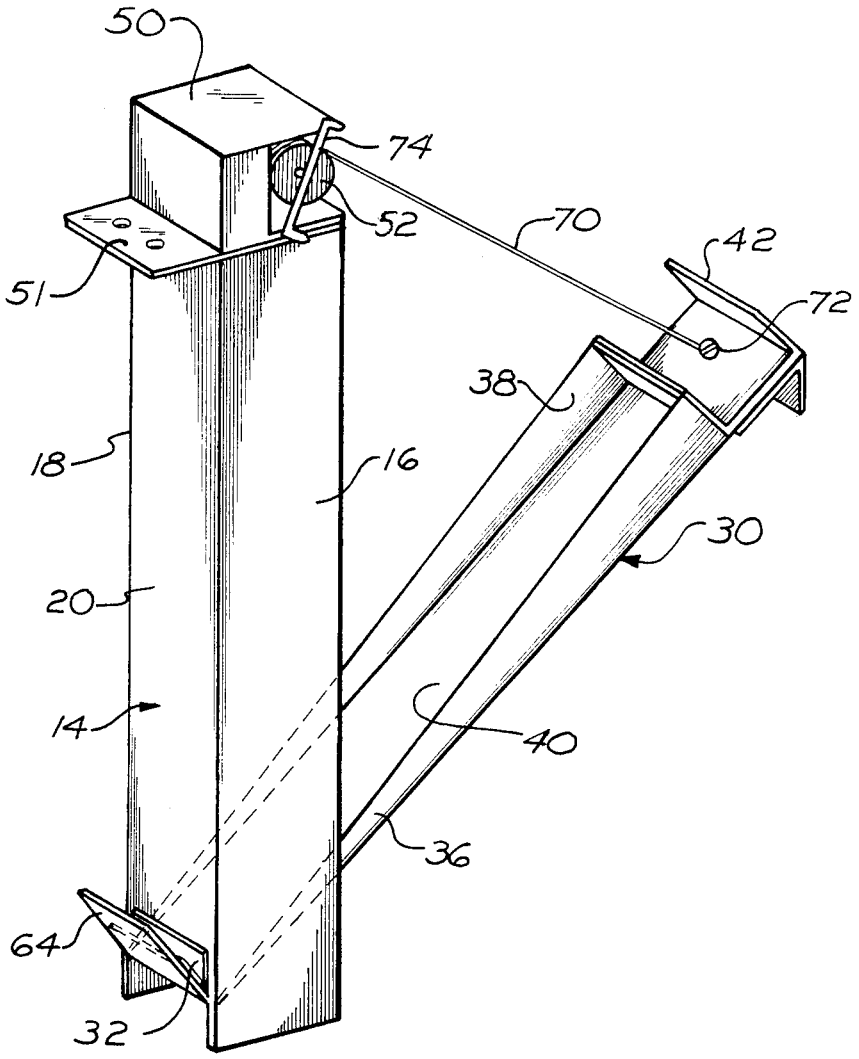
FIG. 4 is a fragmentary perspective view of the collapsible partition assembly of FIG. 1, portions of the assembly being illustrated in phantom and schematically, and portions being removed for purposes of illustrating the invention.

An elongated support frame member, indicated generally by the numeral 14, functions as the principal structural support for the partition assembly 10. Frame member 14 is adapted for mounting to a vertical support 12 along a vertically extending portion thereof in a generally upright orientation. Frame member 14 includes a pair of spaced generally parallel, vertically extending front and rear panels 16 and 18 which extend outwardly away from the vertical support 12. The front and rear panels may be formed by the bending of a strip of metal so that an intermediate rectangular side mounting panel 20 is formed between the front and rear panels. A plurality of openings (not illustrated), may be formed in panel 20 for receiving fasteners (not illustrated) to secure the partition assembly to the vertical support 12. The front and rear panels preferably extend beyond the lower edge of the mounting panel 20 to form a pair of guide legs as best illustrated in FIG. 4.

Partition assembly 10 also includes an expander arm which is indicated generally by the numeral 30. One end of arm 30 is received between the lower extension of panels 16 and 18 of frame member 14. Arm 30 is pivotally mounted to the lower end of mounting panel 20. In the disclosed embodiment of the invention, a hinge 32 is secured to the respective lower ends of the mounting panel 20 and the expander arm 30 to provide the pivotal connection. The arm 30 is preferably formed from a metal sheet which is bent to form spaced front and rear sides 36 and 38 and a cover member 40 which extends therebetween. Cover member 40 has a generally rectangular shape and a width which is preferably commensurate with the width of the mounting panel 20. Front side 36 generally aligns slightyle offset with front panel 16 and rear side 38 generally aligns slightly offset with rear panel 18 of frame member 14 so that when the arm 30 is upwardly pivoted into engagement with the frame member 14, as illustrated in FIG. 1, the frame member and arm cooperate to form an enclosure. In the collapsed mode of FIG. 1, the expander arm 30 essentially functions as a lid and the frame member as a storage receptacle. The frame member and the expander arm may be molded components and need not be constructed from metal as described.

The front side 36 and the rear side 38 of arm 30 preferably have identical tapered shapes which gradually increase in width from the pivot end of the expander arm to the free end of the arm. Because of the tapered side configuration, the free end of arm 30 has a greater weight than the pivotal end of the arm. The center of gravity of the expander arm is thus located at a position spaced outwardly, i.e., away from the mounting panel 20, with respect to a vertical plane which passes through the pivot axis of hinge 32. A plate 42 extends from cover member 40 and projects toward the top of the frame member 14 at the free end of the arm. A reset plate 44, see FIG. 3, which may be slightly angled projects outwardly from cover member 40 adjacent the free end of arm 30.

An optional reel/latch housing 50 is mounted at the top of frame 14. Housing 50 encloses a reel 52 for drawing the expander arm 30 to the collapsed mode of FIG. 1. Housing 50 is dimensioned and positioned so that plate 42 slidably frictionally engages the top of the housing when the device is in the storage mode illustrated in FIG. 1. The frictional engagement is ordinarily sufficient to function as a releasable latch between the arm and the frame to secure the arm in the upright collapsed mode. Other latch mechanisms (not illustrated) may also be employed. A mounting bracket 51 transversely projects from housing 50 for fastening the device to the top of the support 12.

Figure 2:
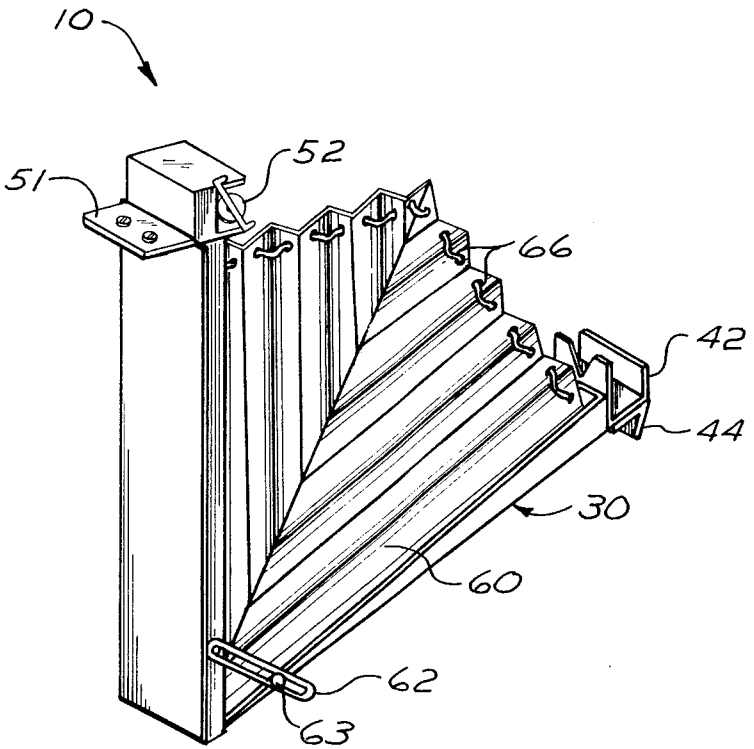
FIG. 2 is a perspective view of the collapsible partition assembly of FIG. 1, said assembly being illustrated in a transitional mode.

With reference to FIG. 2, a foldable panel 60 having a plurality of accordian-like folds, which form an orthogonal pair of generally triangular shaped arrays of collapsible panel sections, extends between frame member 14 and arm 30. The panel sections are substantially rectangularly shaped interconnecting strips of material. In one form of the invention, a boundary panel section of the upper array of panel 60 is affixed to mounting panel 20, and a boundary panel section of the other array of panel 60 is affixed to cover member 40. Panel 60 may be formed from plexiglass, mylar, plastic, aluminum or some other suitable metal. The panel material may be coated with or be comprised of a fluorescent material or may support reflective tape. Adjacent edges of the panel sections which comprise the panel 60 are interconnected by flexible material which functions as a hinge and, depending on the material from which the panel is formed, the hinges may be integral with the panel material. Panel 60 is configured so that when the arm 30 is pivoted to the storage position of FIG. 1, the panel is collapsed in a dual accordian fold-type fashion to thereby fit within the enclosure formed by the cooperating sides and panels of the frame member and the expander arm. For applications wherein the partition assembly is employed in an outdoor environment, slots or other holes (not illustrated) may be formed in the panel 60 to reduce the adverse effects of wind impinging against the extended panel.

It should be appreciated that upon release or disengagement from the latched engagement of the arm and the frame, the arm 30 will fall to the expanded position illustrated in FIG. 3. In the expanded position, panel 60 has a substantially rectangular shape. In the disclosed embodiment, a supplemental impetus is not required to move the expander arm 30 to the expanded position. Because of the tapered side configuration of the expander arm, when the expander arm is a raised position, the top-heavy, offset center of gravity will cause the arm to pivotally fall under its own weight A spring-type mechanism (not illustrated) could also be employed to insure the pivotal drop of the arm.

A slotted bracket 62 may be employed in combination with a pin 63 fixed to the arm to provide a stop to limit the downward pivotal movement of the arm as illustrated in FIGS. 1 through 3. An L-shaped plate 64 as illustrated in FIG. 4 may also or alternatively be mounted on the arm for engagement with the mounting panel 20 to provide a stop for the expander arm. In addition, a plurality of openings may be formed adjacent the periphery of the panel section of the panel 60. A shock cord 66 may be threaded through these openings and secured to the top of frame member 14 and the free end of the arm 30. The shock cord 66 functions to reduce the stress on the panel sections due to the weight of the falling arm 30 by yieldingly resisting the expansion of the panel and the falling of the arm.

One application of the invention is to provide a temporary sign or message board. With reference to FIG. 3, both sides of the panel 60 may be provided with indicia such as the words "STOP", "DANGER", "CAUTION", "DETOUR" or other warning or informational message.

In one form of the invention housing 50 encloses a reel 52. A cord 70 is wound to the reel 52 with the end of the cord being fastened to the outer end of arm 30 by a fastener 72. A crank 74 is located outside of the housing for cranking the reel to wind the cord 70 and thereby pull the arm 30 to the collapsed storage mode. The reel is an optional feature but is very advantageous in embodiment wherein the weight of the expander arm 30 and panel 60 are substantial such as applications providing a removeable partition or room divider in a building. It will be appreciated that the collapsible partition assembly is well suited for prexisting structures having dimensional and structural constraints that do not permit passage of a rigid panel having the expanded dimensions of panel 60 but would permit passage of the partition assembly in the compact storage configuration of FIG. 1.

Collapsible partition assembly 10 is well suited for mounting in a window or behind drapes as a removeable thermal barrier. Naturally, the collapsible partition assembly could also be employed for temporarily displaying traffic warning signs, advertisements, and other messages.

While a preferred embodiment of the foregoing invention is set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A collapsible partition assembly:

elongated frame means adapted to be mounted for disposition in a generally upright orientation;

elongated arm means pivotally mounted at a first end thereof to said frame means, said arm means being pivotal between a first generally upright position wherein said frame means and arm means are generally parallelly oriented and cooperate to form an enclosure and a second position wherein said arm means projects away from said frame means to open the said enclosure;

foldable partition means having first and second edge portions, said first edge portion being connected in fixed relationship to said frame means and said second edge portion being connected in fixed relationship to said arm means, said partition means being substantially entirely enclosable in said enclosure when said arm means is in the first position, said partition means being expandable to form a substantially rectangularly shaped panel when said arm means is in said second position; and latch means for holding said arm means in said first position.

2. The collapsible partition assembly of claim 1 wherein said foldable partition means comprises a plurality of flexibly connected elongated panel strips which cooperate to define a corrugated structure which is expandable and contractable relative to two generally orthogonally disposed axes.

3. The collapsible partition assembly of claim 2 wherein said corrugated structure includes a pair of generally triangular shaped sections with the strips within the two sections respectively being oriented in a pair of transverse directions.

4. The collapsible partition assembly of claim 1 further comprising stop means to limit the pivotal movement of said arm means to said second position.

5. The collapsible partition assembly of claim 1 wherein said arm means has a pivot end and an opposing latch end and comprises a pair of side panels which are tapered from said pivot end to said latch end.

6. The collapsible partition assembly of claim 1 further comprising collapsing means for selectively pivotally moving said arm means from said second position to said first position.

7. The collapsible partition assembly of claim 6 wherein the collapsing means comprises a reel mounted in fixed relation with said frame means and having a cord which is fastened to said arm means.

8. The collapsible partition assembly of claim 3 wherein said partition means sections are right triangles which are interconnected at their hypotenuses.

9. The collapsible partition assembly of claim 2 wherein at least some of said panel strips have an opening and further comprising a cord extending through said opening and connecting said frame means and said arm means to yieldably resist the movement of said arm means from said first position to said second position.

10. The collapsible partition assembly of claim 1 wherein said partition means is affixed with a visual verbal message.

* * * * *